United States Patent [19]

Dyer

[11] 4,145,034

[45] Mar. 20, 1979

[54] HEAT SHIELD FOR A DRILL STRING SHOCK ABSORBING APPARATUS

[75] Inventor: Billy F. Dyer, Houston, Tex.

[73] Assignee: Hughes Tool Company, BHouston, Tex.

[21] Appl. No.: 887,405

[22] Filed: Mar. 16, 1978

[51] Int. Cl.[2] ..... E21B 17/02

[52] U.S. Cl. ..... 267/125; 175/321; 188/264 G

[58] Field of Search ..... 64/23; 175/321; 188/264 G, 274, 276, 322; 267/125, 137

[56] References Cited

U.S. PATENT DOCUMENTS

| | | | |
|---|---|---|---|
| 2,964,137 | 12/1960 | Luedtke et al. | 188/264 G |
| 3,349,858 | 10/1967 | Chenoweth | 175/321 X |
| 3,350,900 | 11/1967 | Harrison | 64/23 |
| 4,055,338 | 10/1977 | Dyer | 267/125 |

*Primary Examiner*—Duane A. Reger
*Attorney, Agent, or Firm*—Robert A. Felsman

[57] ABSTRACT

A shock absorbing apparatus for earth boring drilling is disclosed herein. The shock absorber is of the type having telescoping members with a sealed chamber containing pressurized fluid between the members for supporting load and absorbing shock. The members have axial passages for the passage of high pressure air to the bottom of a borehole to remove cuttings. A tube is connected to one of the members and inserted in telescoping relationship into the axial passage of the other member to transmit the circulating air. The seals of the tube are protected from the heat of the circulating air by a liner disposed concentrically in the tube. The liner is cylindrical and of lesser diameter than the inner diameter of the tube to create an annular air space for thermal insulation.

7 Claims, 1 Drawing Figure

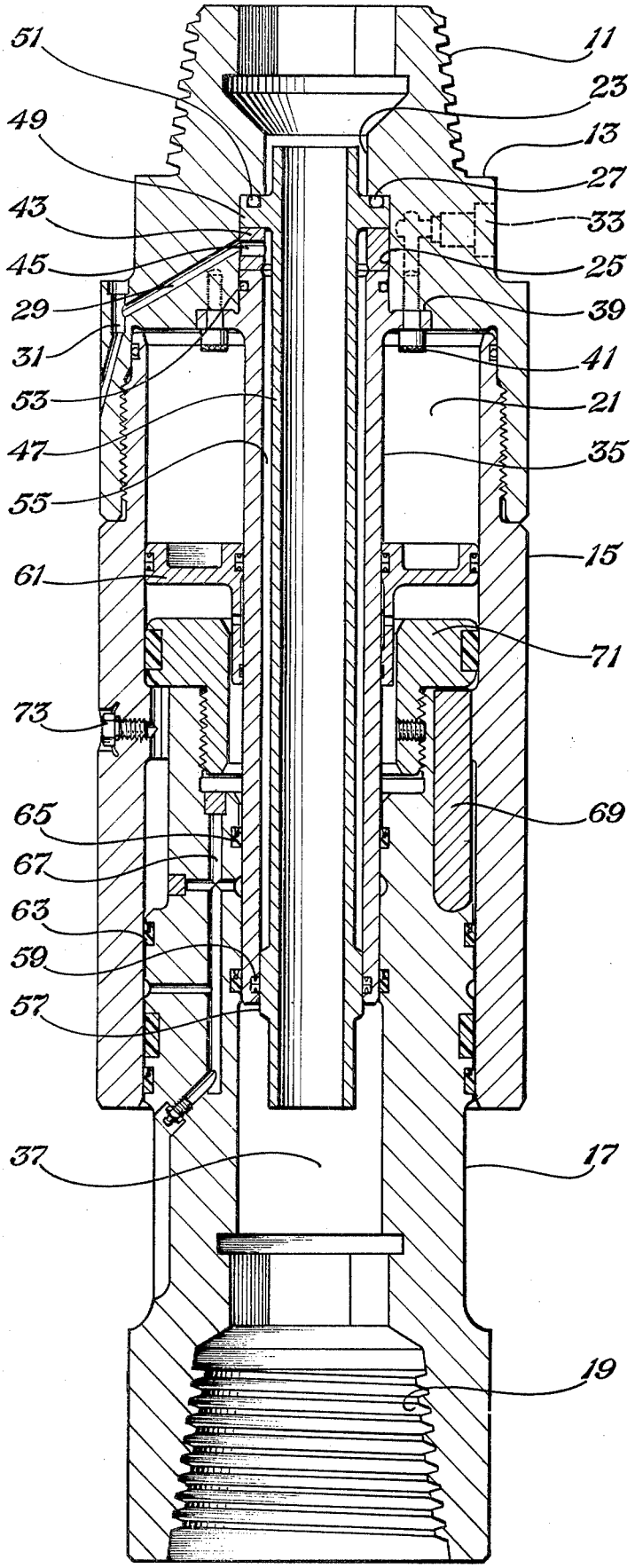
51
11
23
49
13
27
43
33
45
25
29
39
31
41
53
21
47
35
55
15
61
71
73
69
65
67
63
59
57
37
17
19

HEAT SHIELD FOR A DRILL STRING SHOCK ABSORBING APPARATUS

BACKGROUND OF THE INVENTION

1. Field of the Invention

This invention relates in general to rotary well drilling, and in particular to a shock absorbing apparatus placed in the drill string.

2. Description of the Prior Art

In my U.S. Pat. No. 4,055,338, I disclosed a shock absorbing apparatus for use with blast hole drill rigs. Blast hole drill rigs drill shallow holes, approximately 50 feet deep, for lowering explosives to disintegrate the earth for mining. The shock absorber disclosed therein is adapted to be placed in the drill string and operated above the surface of the hole. It contains a pressurized fluid chamber for supporting the load placed on it by the power drive means and for absorbing shock.

These blast hole drill rigs normally use air as the circulation medium. The air is compressed, pumped down the pipes through the shock absorber, and back up the annulus, returning cuttings and dust. Some of the rigs inject water into the air stream above the shock absorber for dust suppression. The air, which is heated to about 200 degrees F. by the compression process, is cooled by the water sufficiently so as to not damage the seals in the shock absorber.

An increasing number of rigs, however, use dust collectors rather than inject water. The air remains at a temperature that may be sufficiently high to damage the shock absorber seals.

SUMMARY OF THE INVENTION

It is accordingly a general object of this invention to provide an improved shock absorber for use in the drill string of a blast hole drill rig.

It is a further object of this invention to provide means for thermally insulating the seals of a pressurized gas chamber shock absorber from hot air being circulated through the drill string.

In accordance with these objects, a shock absorber is provided of the type having telescoping members with axial passages for the passage of the circulated air. One of the members has a tube that extends telescopingly into the axial passage of the other member to transmit the circulating air. A cylindrical liner is mounted concentrically in the tube to shield the tube from the heated air. The liner is smaller in outer diameter than the inner diameter of the tube, defining an annular air space between them for insulating the tube from the liner. The annular space is sealed from the circulating air at the top and bottom and has a vent leading to the exterior for venting the annular space. Additional objects, features and advantages of the invention will become more fully apparent in the following description.

BRIEF DESCRIPTION OF THE DRAWING

The sole FIGURE of the drawing is a vertical cross-sectional view of a shock absorber constructed in accordance with the teachings of this invention.

DESCRIPTION OF THE PREFERRED EMBODIMENT

Referring to the drawing, a threaded portion 11 protrudes from a top sub 13 for connection to a drill string member (not shown). A cylindrical barrel 15 is screwed to the top sub 13, forming a tubular body in cooperation with top sub 13. A mandrel 17 is telescopingly received in barrel 15. Mandrel 17 has a threaded lower end 19 for connection to another drill string member. A pressurized fluid chamber 21 between the mandrel 17 and top sub 13 supports the load placed on the drill string and absorbs shock transmitted up the string from the drill bit.

Top sub 13 has an axial passage 23 for transmitting drilling fluid to the drill bit. Axial passage 23 has an enlarged bore area 25 near its top that is cylindrical and larger in diameter than the portion immediately above it. A downward facing shoulder 27 divides the two portions of the axial passage.

Four ventilating passages 29 extend from vents 31 at the exterior of the top sub 13 to the enlarged bore area 25. Vents 31 are equally spaced about the outer surface of top sub 13. A charging port and valve means 33 is located in the top sub and extends into chamber 21 for introducing gas under pressure. The valve may be similar to that shown in U.S. Pat. No. 3,382,936.

A tube 35 is mounted to top sub 13 and telescopingly extends into an axial passage 37 in mandrel 17 for transmitting drilling fluid. Tube 35 has an annular flange 39 near its top that is connected to the lower surface of top sub 13 by bolts 41. The outer diameter of tube 35 is equal to the diameter of the enlarged bore area 25, and a portion of tube 35 above flange 39 extends into it. An annular spacer 43 is positioned in the enlarged bore area 25 directly above tube 35. Spacer 43 has a plurality of ports 45 in communication with passage 29.

A cylindrical liner or heat shield 47 is carried concentrically inside tube 35, extending both above and below tube 35 a short distance. Liner 47 has an annular flange 49 near its top of diameter equal to the enlarged bore area 25. Flange 49 rests on spacer 43 and is pressed against downwardly facing shoulder 27 by tube 35 as the tube is bolted to the sub 13. Liner flange 49 is sealed against shoulder 27 by seal 51. Tube 35 is sealed to the enlarged bore area 25 by seal 53.

Liner 47 has an outer diameter approximately ¼ inch smaller than the inner diameter of tube 35, defining an annular space 55 for thermally insulating tube 35 from heated air passing through axial passages 23 and 37 and liner 47. Annular space 55 is sealed at the top from the axial passage 23 by the mounting means comprising flanges 39, 49 and spacer 43. Annular space 55 is sealed at the bottom by a band or protrusion 57 formed on liner 47. Band 57 is located adjacent the bottom of tube 35 and is in contact with the inner wall of the tube. A seal 59 located in a groove in the inner wall of tube 35 seals against band 57 to serve along with the band as sealing means.

As explained in more detail in U.S. Pat. No. 4,055,338, all of which material is hereby incorporated by reference, a floating piston-type separator 61 is mounted in chamber 21 for dividing the chamber in an upper gas region and a lower liquid region. Mandrel 17 is mounted below piston 61 with its outer diameter in sliding contact with the inner diameter of barrel 15. A pair of outer seals 63 seal the liquid region from the exterior. A pair of inner seals 65 are located in the axial passage 37 for sealing the liquid region from the circulating drilling fluid. Lubricant chambers and passages 67 provide a supply of lubricant from an exterior source to seals 63, 65 under pressure.

A plurality of drive pins 69 are located in grooves provided in the outer diameter of mandrel 17 and the inner diameter of barrel 15 for rotating the mandrel. A retainer 71 is connected to the top of mandrel 17 above the pins 69 for retaining them and the mandrel inside barrel 15. A port 73 in barrel 15 allows liquid to be introduced into the liquid region of chamber 21.

In operation, the shock absorber is assembled and gas, such as nitrogen, is introduced through port 33 to a select pressure, for example 700 psi. A liquid such as hydraulic oil, is introduced through port 73 to fill the liquid region. The lubricating chambers 67 are filled with grease to a selected pressure, for example 500 psi. The shock absorber is connected into the drill string between the rotary coupling and the drill string. The shock absorber descends with the drill string during the drilling of a hole, but does not normally descend into the hole, rather remains above the surface during drilling. As the drill bit begins to rotate, compressed air is pumped through the drill string, passing through axial passage 23, liner 47, and axial passage 37 of the shock absorber. Although liner 47 will be heated by the air, the annular space 55 will thermally insulate tube 35, reducing the temperature increase on seals 63, 65. Ventilating passages 29 will vent the air in the annular space 65 to the atmosphere as it heats. Laboratory tests have indicated that the vents may be closed off in some cases.

Laboratory tests have shown that the liner and surrounding annular space will reduce the temperature at the seal by an appreciable amount. An inside liner temperature of 230 degrees F. resulted in a temperature at the seals of only 130 degrees F.

It should be apparent that an invention having significant advantages has been provided. The heat shield allows the shock absorber to be operated either with a water injection system or with an air-only circulating system. The heat shield is a relatively simple modification to existing shock absorbers of this type.

While the invention has been shown in only one of its forms, it should be apparent to those skilled in the art that it is not so limited but is susceptible to various changes and modifications without departing from the spirit thereof.

I claim:

1. In a shock absorbing apparatus for use in a drill string of the type having first and second members telescopingly interconnected, the first and second members having axial passages therethrough for the passage of drilling fluid, a tubular member mounted to one of the first and second members and telescopingly inserted in the axial passage of the other member, and an annular sealed chamber between the first and second members containing pressurized fluid for absorbing load and shock, the improvement comprising:

a cylindrical liner mounted concentrically inside the tubular member;

the liner having an outer diameter less than the inner diameter of the tubular member, defining an annular space between the tubular member and the liner for thermally insulating the tubular member from the drilling fluid passing through the axial passages and liner.

2. In a shock absorbing apparatus for use in a drill string of the type having a body adapted to be secured to a drill string member; a mandrel reciprocally mounted to the body for rotation therewith and having a portion to be secured to another drill string member; axial passages within the body and the mandrel for the passage of drilling fluid; a tube carried by the body and inserted in telescoping relationship within the axial passage in the mandrel, and an annular sealed chamber within the body above the mandrel containing pressurized fluid for absorbing load and shock, the improvement comprising:

a liner carried by the body inside the tube;

the liner being cylindrical with an outer diameter being less than the inner diameter of the tube, defining an annular space between the tube and the liner for thermally insulating the inner tube from the drilling fluid passing through the axial passages.

3. The shock absorbing apparatus according to claim 2, further comprising a ventilating passage extending through the body from the annular space to the exterior for venting.

4. In a shock absorbing apparatus for use in the atmosphere in a drill string of the type having a tubular body adapted to be secured to a drill string member; a mandrel reciprocally mounted to the body for rotation therewith and having a portion adapted to be secured to another drill string member; axial passages within the body and the mandrel for the passage of compressed air; a tube carried by the body and inserted in telescoping relationship within the axial passage in the mandrel; and an annular sealed chamber within the body above the mandrel containing pressurized fluid for absorbing load and shock, the improvement comprising:

a cylindrical liner mounted concentrically inside the tube, the liner having an outer diameter less than the inner diameter of the tube, defining an annular space between the liner and the tube for thermally insulating the tube from the compressed air passing through the axial passages and the liner;

mounting means for connecting the liner to the body in a manner preventing drilling fluid from entering the annular space from the top;

seal means at the bottom of the tube for sealing the annular space from the drilling fluid at the bottom; and a ventilating passage extending through the tubular body from the annular space to the exterior for venting.

5. The shock absorbing apparatus according to claim 4 wherein the seal means comprises:

an annular protrusion formed in the liner and extending from the liner to the tube; and a resilient seal located between the protrusion and the tube.

6. The shock absorbing apparatus according to claim 4 wherein the mounting means comprising:

a first annular flange on the tube adjacent its top for bolting to the tubular body;

a second annular flange on the liner adjacent its top;

the axial passage of the tubular body having an area with an enlarged bore, and a downwardly facing inner shoulder above the area for bearing against the second flange; and a spacer ring positioned in the area between the tube and the second flange for forcing the second flange against the shoulder when the first flange is bolted to the tubular body.

7. The shock absorbing apparatus according to claim 6 wherein the ventilating passage leads from the exterior to the enlarged bore area, and wherein the spacer ring has a port communicating the annular space with the ventilating passage.

* * * * *

UNITED STATES PATENT OFFICE

CERTIFICATE OF CORRECTION

Patent No. 4,145,034 Dated March 20, 1979

Inventor(s) BILLY F. DYER

It is certified that error appears in the above-identified patent and that said Letters Patent are hereby corrected as shown below:

Claim 4, lines 35 and 38 "drilling fluid" is changed to --- compressed air ---.

Signed and Sealed this

*Twentieth* Day of *May 1980*

[SEAL]

*Attest:*

SIDNEY A. DIAMOND

*Attesting Officer*

*Commissioner of Patents and Trademarks*